United States Patent [19]

Clark

[11] Patent Number: 5,042,525

[45] Date of Patent: Aug. 27, 1991

[54] REGULATOR HANGER

[76] Inventor: Raymond S. Clark, 7226 Green Farms Dr., Cincinnati, Ohio 45224

[21] Appl. No.: 544,108

[22] Filed: Jun. 26, 1990

[51] Int. Cl.[5] ..... F16K 27/08

[52] U.S. Cl. ..... 137/381; 137/343; 137/908; 248/339; 248/692

[58] Field of Search ..... 128/204.26, 204.28; 248/690, 691, 692, 339; 137/381, 908, 205.24, 343

[56] References Cited

U.S. PATENT DOCUMENTS

| | | | |
|---|---|---|---|
| 868,130 | 10/1907 | Russell | 251/229 |
| 1,313,808 | 8/1919 | Fuller | 248/339 |
| 1,781,054 | 11/1930 | Dockson | 137/71 |
| 2,260,707 | 7/1940 | Shaw | 137/382 |
| 2,310,189 | 2/1943 | Deming | 128/204.26 |
| 2,686,530 | 8/1954 | Dire | 137/381 |
| 2,881,757 | 4/1959 | Haverland | 128/205.24 |
| 3,035,605 | 5/1962 | Ninnelt | 137/382 |
| 3,125,242 | 3/1964 | Davis | 137/381 |
| 3,199,820 | 8/1965 | Thompson | 248/339 |
| 3,677,267 | 7/1972 | Richards | 128/204.18 |
| 4,079,735 | 3/1978 | Gaffney | 128/204.18 |
| 4,159,717 | 7/1979 | Cossey | 128/204.26 |
| 4,219,017 | 8/1980 | Shamlian et al. | 128/204.26 |
| 4,307,748 | 12/1981 | Mathias | 137/491 |
| 4,392,490 | 7/1983 | Mattingly et al. | 128/204.18 |
| 4,460,089 | 7/1984 | Abbott | 128/204.26 |

OTHER PUBLICATIONS

Trident ® Diving Equipment, p. 19, DA20 "Regulator Hanger" 1991.

*Primary Examiner*—A. Michael Chambers
*Attorney, Agent, or Firm*—Wood, Herron & Evans

[57] ABSTRACT

A dust cover is provided with a transverse hook such that when the dust cover is secured in place on the first stage of a scuba regulator, the regulator assembly can be handled and hung by the hook without damage to the regulator or damage or kinking of regulator hoses. Embodiments for both American and European (DIN) configured regulators are enclosed.

4 Claims, 2 Drawing Sheets

REGULATOR HANGER

FIELD OF THE INVENTION

This invention relates to scuba diving equipment and more particularly to improved dust covers for use with the first stage of a two-stage scuba regulator.

BACKGROUND OF THE INVENTION

The term "SCUBA" is an acronym for "self-contained underwater breathing apparatus." Scuba diving has become an increasingly popular sport over the years. Due to this increasing popularity, there have been a proliferation of dive shops which specialize in renting and selling scuba diving equipment.

One of the integral components of scuba diving apparatus is the air regulator which supplies the diver with breathing air from a high-pressure tank. Typically, scuba regulators are two-stage, single-hose devices which include a first stage regulator connected to a second stage regulator through an intermediate pressure hose for delivering clean, dry air at ambient pressure to the diver. The first stage is attached to the high pressure air tank and reduces high air pressure, at about 2000 or 3000 psi or so to an intermediate pressure level of about 140 psi. Air at 140 psi is conducted through the hose to the second stage regulator where air at ambient pressure is delivered on demand to the diver via a mouthpiece. In addition, a high pressure hose is usually connected to the first stage and to a submersible pressure gauge or instrument console. A third hose may be attached to the regulator for conveying air to a power inflator for the buoyancy compensation device now frequently worn by divers. U.S. Pat. No. 4,219,017 shows one type of such a two stage regulator, with only the single hose connecting the two regulator stages.

The first stage typically includes a machined body having a high pressure inlet that mates with an outlet valve of the high pressure tank during use. The machined body of the first stage according to American standards also typically has a yoke adjacent to the high pressure inlet to provide a coupling, through an opposed screw, to the high-pressure tank. The body and yoke may be made of chrome plated brass, or other similar material. When the regulator is not in use, it is common to insert a dust cover between the high pressure inlet of the regulator's first stage and the yoke-mounted screw which is tightened onto the dust cover to hold it in place, sealing and protecting the high pressure inlet.

Oftentimes, when either personal or rental regulator apparatus is not being used, divers and dive shop attendants hang the entire apparatus by the yoke from a nail or hook on a wall. In a crowded, busy dive shop, the rental regulators are frequently taken on and off the nails from which they are hung. Such practices oftentimes result in damage to the regulators or their finishes because the nails or hooks upon which the regulators are hung may scratch or otherwise mar the surface of the regulators and/or yokes thereby eventually allowing them to rust. This is undesirable because it may shorten the useful lifetime of the regulator, which is an expensive device. Moreover, such indiscriminate storage may kink or cause severe bends in the hoses shortening their useful lives.

In another form of regulator configured to meet the European or DIN specifications, the first stage is not provided with a yoke but rather with a protruding, externally threaded high pressure inlet. This is screwed into a tank valve when in use. Such a regulator may frequently be hung by its appended hoses, when not in use, causing undesirable hose kinking or wear.

Accordingly, it is one objective of this invention to provide improved means for storing or hanging scuba regulators of either American or European configurations.

SUMMARY OF THE INVENTION

To these ends, a preferred embodiment of the present invention includes a dust cover having a protruding hook. This apparatus serves the dual function of protecting the high pressure inlet in the first stage of a two stage regulator, while simultaneously providing means by which the regulator can be stored and hung when not in use without use of the yoke, regulator and hose as a hanger, thereby extending the useful life of the regulator and hoses and minimizing the damage thereto which occurs when the regulator is hung by the yoke.

In a preferred embodiment, the apparatus of the present invention includes a dust cover and a hook extending from the dust cover. The dust cover is adapted to be seated on the high pressure inlet of the first stage of a two-stage regulator that conforms to American specifications and is held in place by a yoke mounted screw. The hook member extends transversely from the dust cover member and provides a means by which the entire regulator apparatus can be suspended from a wall hook or nail when not in use.

In an alternative embodiment, the dust cover member is adapted to be seated on and protect the high pressure inlet of the first stage of a two-stage regulator that conforms to European or DIN specifications. In this embodiment, the dust cover member includes an internally threaded bore for screwing onto the male portion of the first stage, thereby protecting the inlet and providing a hanger. Thus, it is not necessary to mar the regulator or yoke surfaces or to drape hoses over hooks or nails for storage. The dust covers also provide means by which the regulators can be hung up or more easily handled on dive boats or for transportation.

These and other objectives and advantages will become readily apparent from the following detailed description of a preferred embodiment and from the drawings in which:

DETAILED DESCRIPTION OF THE INVENTION

Figure 1:
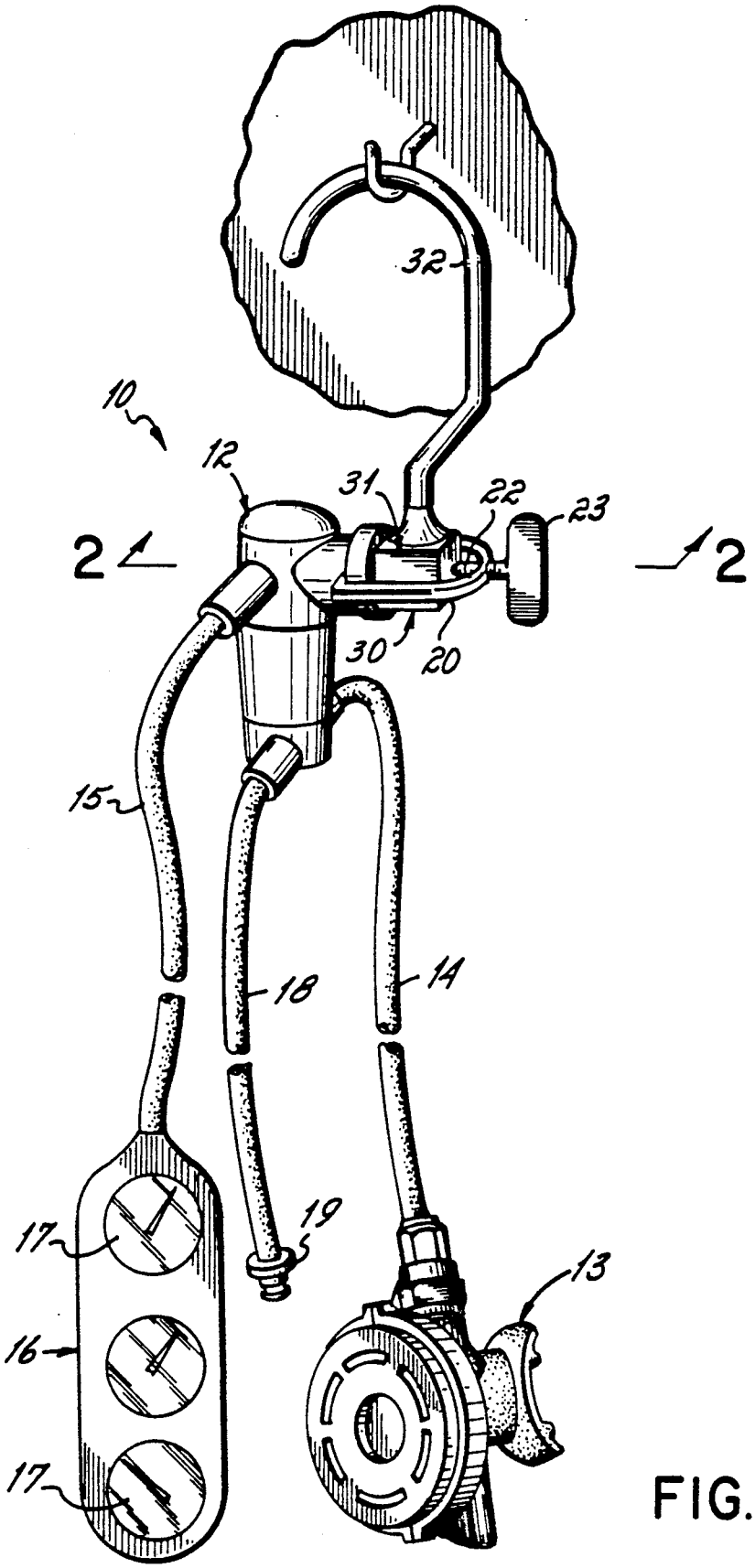
FIG. 1 is a perspective view showing one embodiment of the present invention in place and suspending a regulator apparatus from a wall hook.

Turning now to the drawings, there is shown in FIG. 1 a scuba regulator assembly 10 in combination with one embodiment of the invention. Regulator assembly 10 includes a first stage regulator 12, a second stage regulator 13 and an intermediate pressure hose 14 operably connecting the two stages. Regulator assembly 10 typically also includes a high pressure hose 15 connecting a high pressure port from the first stage 12 to an instrument console 16, including submersible pressure gauge 17. Also included in regulator apparatus 10 is a hose 18 with fitting 19 for operable connection to the power inflator of a buoyancy compensator (not shown).

Figure 2:
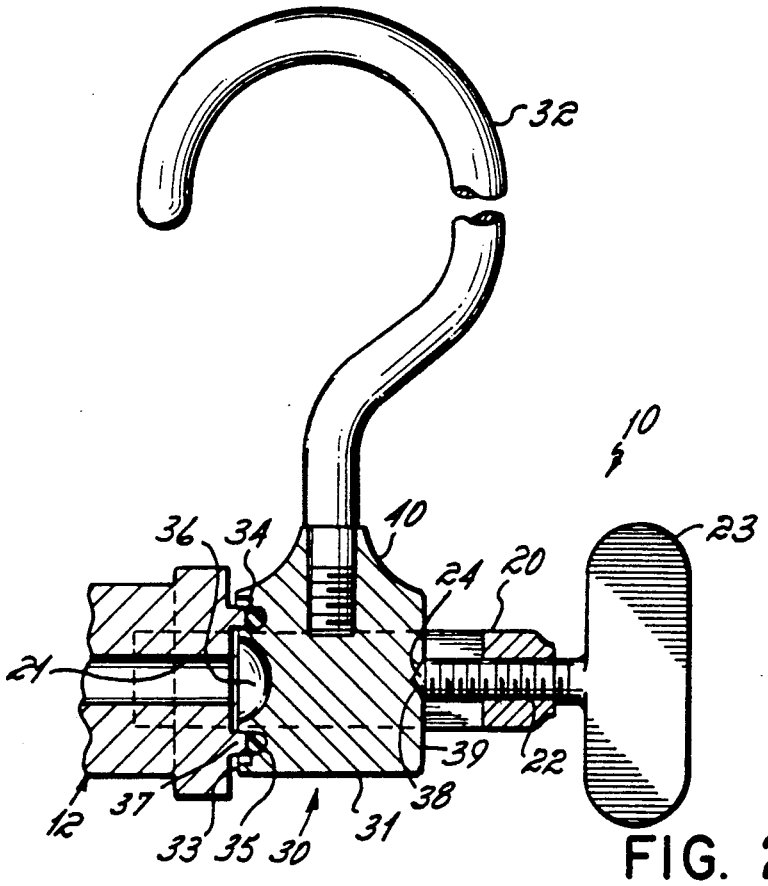
FIG. 2 is a cross-section, partially broken away, of the invention taken along line 2—2 of FIG. 1.

First stage 12 includes a typical U-shaped yoke 20 extending outwardly from the first stage 12 around a high pressure inlet 21 (FIG. 2). A screw 22, attached to knob 23 is threaded into yoke 20 and has a forward pointed end 24 (FIG. 2) extending toward high pressure inlet 21.

A hanger means 30, according to the invention is disposed over the high pressure inlet 21 within yoke 20. Hanger means 30 includes a dust cover 31 and a hook 32 extending therefrom, in this embodiment transversely and beyond the yoke 20.

As best shown in FIG. 2, the dust cover 31 includes a forward face 33 in which is formed an annular groove 34, provided with an 0-ring seal 35. A concave relieved area 36 may be located within the area surrounded by groove 34, although not necessary. Thus, the groove 34 and seal 35 generally correspond in structure to a tank valve coupling structure, and seal about lip 37 of the high pressure inlet 21 to protect it against dust, water or other contamination when not in use.

This sealing is maintained by the pressure exerted on dust cover 31 by screw 22, the pointed end 24 of which engages a detent or depression 38 located on rear face 39 of dust cover 31. Detent 38 is preferably coaxial with annular groove 34.

The hook 32 extends transversely from a side 40 of dust cover 31, and is preferably of a larger, overall configuration, with respect to first stage 12, so as to facilitate handling.

As best seen in FIG. 1, the hook 32 is used to hang the entire regulator assembly 10 on a wall hook or nail or in any other convenient location. It does not require engaging yoke 20 over a hook or nail. Moreover, all the hoses are left to hang freely without kinking or damage and without using them to support the first stage 12.

Figure 3:
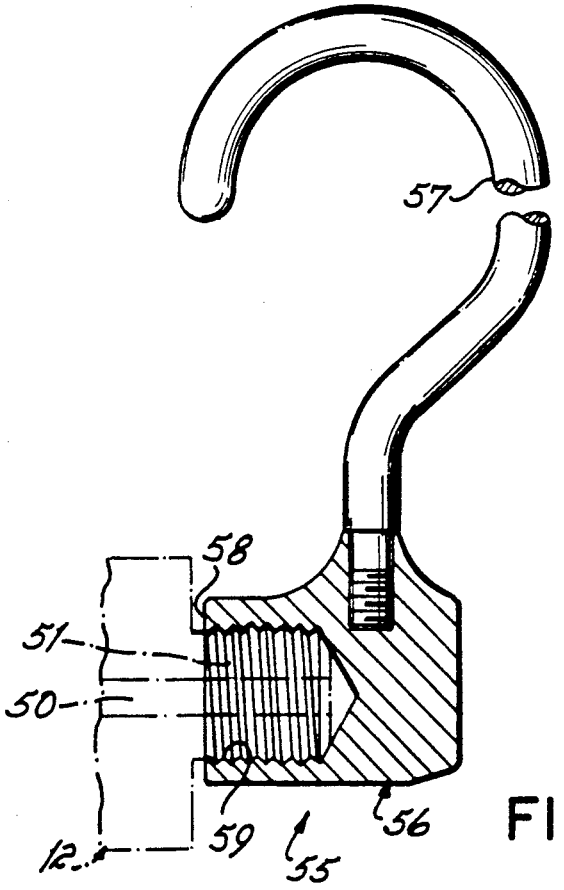
FIG. 3 is a cross-section, partially in phantom, of an alternative embodiment of the present invention.

An alternative embodiment, particularly useful for European or DIN specification regulators is illustrated in FIG. 3. A part of a European regulator configuration is shown wherein the high pressure inlet 50 is disposed in an externally threaded cylindrical projection 51. There is no yoke.

The alternate hanger means 55 includes a dust cover 56 and hook 57. A forward face 58 is provided with an internally threaded bore 59. Threads in bore 59 correspond with threads on projection 51 so dust cover 56 is screwed onto projection 51. This seals and protects the high pressure inlet 50 while at the same time securing the dust cover to the regulator.

Hook 57 extends from dust cover 56 and is of similar size to hook 32 of the preferred embodiment. When in use, the European or DIN configured regulator can also be hung up by means of hook 57 without damage to regulator or associated hoses.

In either embodiment described hereinabove, the hook and dust cover are integrally connected by a threaded connection, welding or other suitable means. Furthermore, the dust cover and hook are preferably chrome plated brass or stainless steel. Alternatively, the device of the present invention may be molded or otherwise formed from a suitable thermoplastic material, or provided with plastic or rubber coatings.

Further alternatives and modifications of the hanger means of the present invention can be readily appreciated by those of skill in the art without departing from the scope of the present invention, and applicant intends to be bound only by the appended claims.

What is claimed is:

1. A hanger for hanging a SCUBA apparatus not in use wherein said SCUBA apparatus is of the type comprising a high pressure first stage regulator having a high pressure inlet port, means for attaching said inlet port to a tank valve, a lower pressure second stage regulator, and at least one hose operatively interconnecting said stages, said hanger comprising:

a hanger body;

means on said hanger body for engaging and supporting said high pressure first stage regulator attaching means of said SCUBA apparatus when not in use; and hook means extending from said hanger body for supporting said body, and any additional SCUBA apparatus supported thereon, with said hose and said second stage hanging downwardly therefrom.

2. A hanger for hanging SCUBA apparatus not in use wherein the SCUBA apparatus is of the type comprising a high pressure first stage regulator having a higher pressure inlet port, a yoke means for attaching said firs stage regulator inlet port to a tank valve, and at least one hose extending from said first stage, which hose is connected to a low pressure second stage regulator, said hanger comprising:

a hanger body;

said hanger body having a sealing means for sealing said high pressure inlet port when said apparatus is not in use and said hanger body is operatively disposed within said yoke means over said port; and a hook means extending from said hanger body for hanging said first stage regulator with said hose hanging downwardly from said first stage regulator.

3. A hanger as in claim 2 wherein said sealing means comprises a seat on one side of said body for engaging said inlet, a detent on another side of said body, for receiving a yoke mounted screw apparatus when said hanger is operably attached to said first stage within said yoke and wherein said hook means extends from said body between said seat and said detent for hanging said regulator.

4. A hanger for hanging SCUBA apparatus not in use wherein the SCUBA apparatus is of the type comprising a high pressure first stage regulator having a higher pressure inlet port defined in part by an externally threaded protrusion on said regulator for connecting said first stage to a tank valve, and at least one hose extending from said first stage regulator inlet port, said hose connected to a low pressure second stage regulator, said hanger comprising:

a hanger body;

an internally threaded base in said hanger body for operative disposition over an externally threaded high pressure inlet port protrusion of a first stage regulator when said first stage regulator is not in use to connect said hanger body thereto; and a hook extending from said hanger body for hanging said first stage regulator with said hose hanging downwardly from said first stage regulator.

* * * * *

UNITED STATES PATENT AND TRADEMARK OFFICE

CERTIFICATE OF CORRECTION

PATENT NO. : 5,042,525

DATED : August 27, 1991

INVENTOR(S) : Raymond S. Clark

It is certified that error appears in the above-indentified patent and that said Letters Patent is hereby corrected as shown below:

Column 4, line 25, "higher" should be -- high --.

Column 4, line 26, "firs" should be -- first --.

Column 4, line 50, "higher" should be -- high --.

Signed and Sealed this

First Day of November, 1994

*Attest:*

*Attesting Officer*

Bruce Lehman

BRUCE LEHMAN

*Commissioner of Patents and Trademarks*